US012631088B2

(12) United States Patent
Kundapur et al.

(10) Patent No.: US 12,631,088 B2
(45) Date of Patent: May 19, 2026

(54) BACK PRESSURE VALVE FOR CARBON CAPTURE SYSTEMS

(71) Applicant: Schlumberger Technology Corporation, Sugar Land, TX (US)

(72) Inventors: Karthik Kundapur, Rosharon, TX (US); Vinod Chakka, Rosharon, TX (US); Arunkumar Arumugam, Sugar Land, TX (US); David Gomez Ramirez, Rosharon, TX (US); Brad Swenson, Rosharon, TX (US); Oguzhan Guven, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/081,112

(22) Filed: Mar. 17, 2025

(65) Prior Publication Data

US 2025/0290388 A1 Sep. 18, 2025

Related U.S. Application Data

(60) Provisional application No. 63/565,685, filed on Mar. 15, 2024.

(51) Int. Cl.
*E21B 34/08* (2006.01)
*E21B 41/00* (2006.01)

(52) U.S. Cl.
CPC ..... *E21B 34/08* (2013.01); *E21B 41/0064* (2013.01)

(58) Field of Classification Search
CPC .. E21B 34/08; E21B 41/0064; E21B 41/0057; E21B 43/164
See application file for complete search history.

(56) References Cited

U.S. PATENT DOCUMENTS

| | | | | | |
|---|---|---|---|---|---|
| 2,203,957 | A * | 6/1940 | Glitsch | E21B 43/123 | 417/115 |
| 3,405,647 | A * | 10/1968 | Bryan | E21B 43/123 | 137/155 |
| 3,633,669 | A * | 1/1972 | True | E21B 23/08 | 166/212 |
| 5,101,907 | A * | 4/1992 | Schultz | E21B 23/0412 | 166/336 |
| 6,328,103 | B1 * | 12/2001 | Pahmiyer | E21B 49/081 | 166/387 |
| 9,453,398 | B1 * | 9/2016 | Zhang | E21B 43/123 | |
| 2012/0003043 | A1 * | 1/2012 | Cawley | E21B 43/164 | 405/53 |
| 2015/0330183 | A1 * | 11/2015 | Sevheim | E21B 34/10 | 166/375 |
| 2020/0378215 | A1 * | 12/2020 | Brown | E21B 21/08 | |
| 2021/0293123 | A1 * | 9/2021 | Watson | E21B 43/12 | |

* cited by examiner

*Primary Examiner* — David Carroll
(74) *Attorney, Agent, or Firm* — Kyle R. Miiller

(57) ABSTRACT

Embodiments of the disclosure provide for methods and apparatus related to geological carbon capture systems. Aspects disclose methods and apparatus related to back pressure valves protecting geological based carbon capture systems. These methods and apparatus seek to enhance the efficiency and reliability of carbon capture by addressing the operational challenges posed by subsurface pressure variations. By employing advanced back pressure valve mechanisms, the systems ensure controlled injection and containment of carbon dioxide within geological formations, thereby minimizing the risk of leakage and contributing to long-term environmental sustainability.

15 Claims, 7 Drawing Sheets

BACK PRESSURE VALVE FOR CARBON CAPTURE SYSTEMS

CROSS-REFERENCE TO RELATED APPLICATIONS

The present application claims priority to U.S. Provisional Application 63/565,685 entitled "Back Pressure Valve," filed Mar. 15, 2024, the entirety of which is incorporated by reference.

FIELD OF THE DISCLOSURE

Aspects of the disclosure relate to geological carbon capture systems. More specifically, aspects of the disclosure relate to back pressure valves protecting geological based carbon capture systems.

BACKGROUND

Carbon capture systems are being widely adopted as a crucial strategy to mitigate the effects of global climate change. These systems are designed to capture carbon dioxide emissions from various sources, such as power plants and industrial processes, and store them securely to prevent their release into the atmosphere. The increasing adoption of carbon capture technologies reflects the urgent need to address the rising levels of greenhouse gases that contribute to global warming and climate instability.

Developing carbon capture systems, especially geological carbon capture systems, presents several challenges. These challenges include the need for precise geotechnical temperature regulation, which is essential to maintain the integrity and functionality of the storage sites. Icing and condensate formation within the storage systems can significantly impair their efficiency and safety, leading to potential failures. Moreover, the economic costs associated with developing and maintaining these systems are substantial. High costs can deter investment and slow the deployment of carbon capture technologies, making it imperative to find cost-effective solutions.

Development costs play a major role in planning and implementing carbon capture projects. Lower cost systems are often given preference over higher cost fields due to budget constraints and the need to maximize the return on investment. This economic consideration drives the search for innovative technologies and methods that can reduce the overall expenses associated with carbon capture and storage. By prioritizing cost-effective solutions, stakeholders can enhance the feasibility and scalability of carbon capture initiatives.

While still relatively new, carbon capture technologies represent an expanding economic field aimed at combating global climate change. The development and deployment of these technologies create new opportunities for businesses and industries to contribute to environmental sustainability. As the demand for carbon capture solutions grows, so does the potential for economic growth and job creation in this sector. This burgeoning field offers a proactive approach to reducing carbon emissions and promoting a cleaner, more sustainable future.

The field of geological carbon capture systems is particularly notable for its use in locations of former hydrocarbon fields. These systems leverage the existing geological formations that once housed oil and gas reserves to store captured carbon dioxide. Despite their necessity in the carbon capture development cycle, geological carbon capture systems face significant drawbacks. One major concern is the potential for over pressurization of geological systems due to ice accumulations. This over pressurization can lead to system failures and pose serious safety risks. Additionally, conventional back pressure valves are often unsuitable for carbon capture systems, increasing the likelihood of errors and malfunctions. Worker safety is a prime concern, as over pressurization accidents can result in severe injuries or fatalities.

Another drawback of existing conventional technologies is the excessive time required to complete carbon capture projects. The components and parts used in these systems have not been sufficiently developed to withstand the demands of field operations and ensure long-term functionality. This lack of rugged, durable components can lead to frequent maintenance and replacements, further escalating the costs and reducing the overall efficiency of the systems.

There is a need to provide a more economical way to develop carbon capture fields compared to conventional technologies. Innovative approaches and advanced materials are necessary to reduce the costs associated with these systems and enhance their feasibility. By focusing on cost reduction, stakeholders can accelerate the adoption of carbon capture technologies and make a more significant impact on reducing greenhouse gas emissions.

There is a need to provide additional worker safety compared to conventional technologies. Ensuring the safety of workers involved in the development and operation of carbon capture systems is paramount. This requires the implementation of robust safety measures and the development of components that can withstand the operational pressures and environmental conditions of carbon capture sites. Enhanced safety protocols and reliable equipment will help protect workers and minimize the risks associated with carbon capture operations.

There is a need to provide an apparatus and methods that are easier to operate than conventional apparatus and methods.

There is a further need to provide apparatus and methods that do not have the drawbacks discussed above.

There is a still further need to reduce economic costs associated with operations and apparatus described above with conventional tools.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one embodiment, a back pressure valve is disclosed. The back pressure valve may include a manifold section and an on-off section. The on-off section may be configured with a piston movable from a closed position to an open position and a double face poppet valve. The on-off section may also be configured with a spring connected to the double face poppet valve, wherein the spring is configured to bias the double face poppet valve to a sealed position, preventing a carbon dioxide liquid from escaping a reservoir.

In another example, a back pressure valve is provided. This back pressure valve may include a body defining an interior volume. The back pressure valve may also include a series of ports extending through a side wall of the body. The back pressure valve may also include a piston placed within the body, moveable from a closed position to an open position. The back pressure valve may also include a spring connected to the piston, biasing the piston to the closed position, covering the series of ports with a side of the piston. The back pressure valve may also include a pilot operated check valve placed within the interior volume having a pilot side and a check valve side. The back pressure valve may also include a flow restrictor connected to the body on the check valve side and configured to restrict a flow of liquid carbon dioxide traveling from a top of the piston to a bottom of the piston.

In another example embodiment, a back pressure valve is disclosed. The back pressure valve may include a body defining an interior volume. The back pressure valve may also include a spring-loaded valve placed within the interior volume. The back pressure valve may also include a pressure vessel defining a pressure vessel interior volume. The back pressure valve may also include a control line having a first end and a second end, wherein the first end is connected to the pressure vessel and the second end is connected to the interior volume of the body.

In another example embodiment, an apparatus is disclosed. The apparatus may include a metering module. The metering module may include a metering section and a spring-loaded piston. The apparatus may also include a valve, wherein the spring-loaded piston is biased towards a first closed position, and wherein the spring-loaded piston translates down a body of the metering module upon an increase in pressure from an injection end of the metering module, overcoming a bias pressure during the first closed position to a second open position, allowing fluid to translate down the body of the metering module to a reservoir end section.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted; however, that the appended drawings illustrate only typical embodiments of this disclosure and are; therefore, not be considered limiting of its scope, for the disclosure may admit to other equally effective embodiments.

Figure 1:
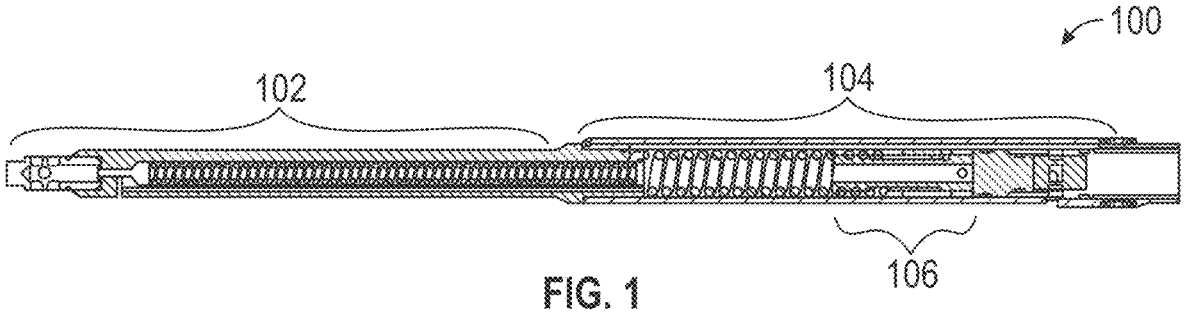
FIG. 1 is a side view of a back pressure valve for carbon capture systems in one example embodiment of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood; however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments, and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer, or section. Terms such as "first", "second", and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

When an element or layer is referred to as being "on", "engaged to", "connected to", or "coupled to" another element or layer, it may be directly on, engaged, connected, coupled to the other element or layer, or interleaving elements or layers may be present. In contrast, when an element is referred to as being "directly on", "directly engaged to", "directly connected to", or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood; however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

In some embodiments, methods described may be stored in a non-volatile memory. In some embodiments, the non-volatile memory may be defined as an article of manufacture. In embodiments, the non-volatile memory is configured such that the methods may contain a list of instructions that may be read by a computing device and the list of instructions performed. The list of instructions may perform calculations, illustrate graphic results on a visual device, such as a monitor, print results or store data for further use, as non-limiting embodiments. The list of instructions may be executable in their own programming or may be executed using other programming. The list of instructions may be stored in various configurations, such as a compact disk, a floppy disk, a solid-state drive, a computer hard drive, a server, a web-oriented storage device, and a cloud-computing device or system. Embodiments of methods described may control other systems, such as machines, to perform specified functions. Operational control may be performed through additional programming and/or operation of other computing or control devices. Embodiments described may be implemented using wireless technologies to allow for computing and execution of the list of instructions from various locations. Computing may occur, for example, in various platforms, including a personal computer, a laptop computer, a computer server, a cloud-based computer, a mainframe computer, a cellular telephone and a cellular connected device.

Embodiments of the methods described may use other programming technologies to help implement the methods described. In some embodiments, machine learning programming may be used to evaluate data and provide results. In some embodiments, training datasets may be used to allow for convergence of needed results and thus using pretrained machine learning programming is considered within the scope of the disclosure. In other instances, artificial intelligence programming systems may be implemented as part of the disclosure or may be incorporated within the methods described. Such artificial intelligence systems may be used in various capacities, including results generation, error detection, problem definition and problem convergence methods. Graphical representation of results obtained by artificial intelligence systems is also considered within the scope of the disclosure.

In embodiments using machine learning and/or artificial intelligence, programming may be altered by the programming based upon instructions provided. As such, in one non-limiting embodiment, different nodal layers of evaluation may be provided for analysis. The different nodal layers provided may incorporate modification techniques to allow for accurate reading and evaluation of large datasets. The large datasets may be designated training datasets or may be actual data that is desired to be evaluated. Coefficients used for corresponding different nodal layers may be developed within the methods described or may be pre-set according to training. Such coefficients may be altered by the computer programming itself or may be designated by a computer user. As a non-limiting embodiment, if possible results from analysis disclose too many potential outcomes or results, a computer operator may be asked or may alter the analysis protocol to achieve more focused results.

In embodiments, computer code may be any programming code that lists instructions to be followed. Programming codes may include instructions provided by a computer programmer with or without assistance by computers. Programming may occur through use of a library of programs or subroutines to section programming tasks. Programming may be accomplished to run on different operating systems or may be included with internal executable files for stand-alone computer instructions.

Carbon dioxide injection is one of the several ways to reduce greenhouse effects, in practice. Injecting carbon dioxide poses certain risks if it is not maintained in a liquid phase. When carbon dioxide is not maintained in a liquid form, a rapid expansion and subsequent cooling caused by carbon dioxide could pose several operational and safety risks. These risks may be, for example:

- Carbon dioxide hydrate and ice formation following contact of the cold carbon dioxide with the interstitial water around the wellbore and the formation water in the perforations at the near well zone. Carbon dioxide hydrate formation poses a significant risk of well blockage. Ice formation may severely reduce the reservoir injectivity and ultimately its storage capacity.
- Thermal stress shocking of the wellbore casing steel leading to its fracture and the escape of carbon dioxide. With the presence of juxtaposing warm and cold areas within the geological stratum and wellbore, thermal stress shocking of the reservoir rocks and systems can occur. This may lead to fracture of the rock or systems thus changing the reservoir permeability and reducing its 'carbon dioxide locking' effectiveness.
- Superheating of the liquid carbon dioxide at the wellhead leading to violent evaporation and over-pressurization followed by carbon dioxide backflow into the injection system.

To guard against these potential risks, the use of a back pressure valve or back pressure system will maintain a column of carbon dioxide in liquid state. This is achievable as such configurations allow a minimum pressure to be constantly maintained.

Configuring systems with a back pressure valve and a flow regulator facilitates high-capacity carbon dioxide injection and maintains a constant differential pressure. Such configurations may be used in depleted oil and gas fields chosen for carbon dioxide sequestration thereby potentially extending the useful economic life of the reservoir regardless if the reservoir stores liquid or gas hydrocarbons. A variety of types of carbon sequestration can be used with various carbon dioxide injection applications where the requirement is to keep the phase of the carbon dioxide in liquid state. As will also be understood, other types of fluids may be injected rather than carbon dioxide, and as such, carbon dioxide is just one non-limiting fluid discussed for clarity.

Features of aspects of the disclosure may include:

Provisions for constant back pressure along a wide range of injection rates to maintain carbon dioxide in liquid phase.

Pressure holding capabilities from an up-hole column to maintain a fluid column in the well bore during shut in.

Retrievability using wireline tools.

A lack of operator input while providing a passive and autonomous system. In some embodiments, no control lines are provided for actuation of the valves.

Aspects of the disclosure may be used in a variety of environments. Carbon dioxide injection is contemplated for, but not limited to; oil and gas reservoirs, saline aquifers, unmineable coal seams, and basalt formations.

Figure 2A:
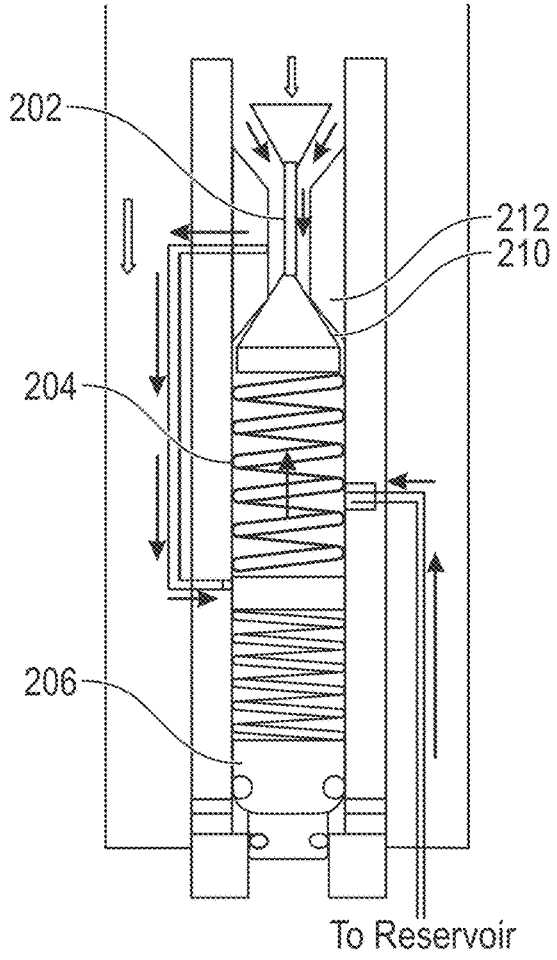
FIG. 2A is a side sectional view of a back pressure valve in a closed position in one example embodiment of the disclosure.
Figure 2B:
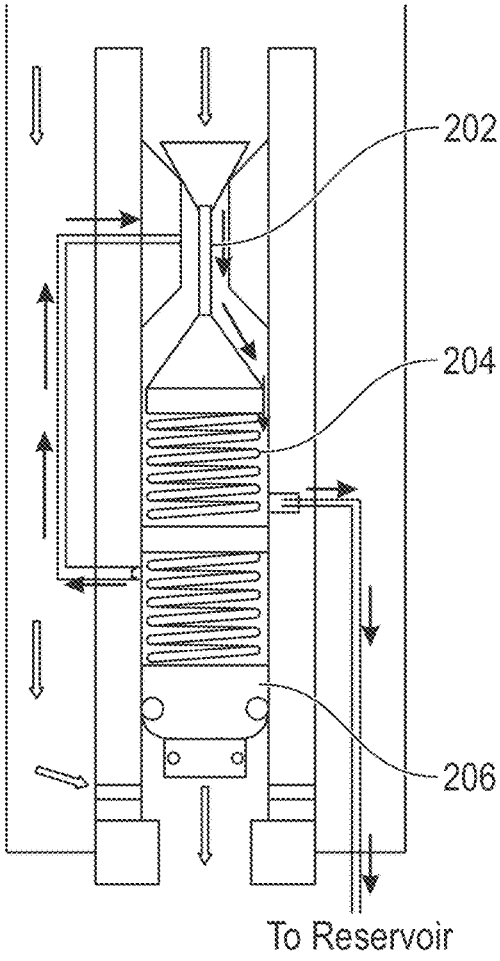
FIG. 2B is a side sectional view of a back pressure valve in a open position in one example embodiment of the disclosure.

Referring to FIG. 1, as described herein in some embodiments, a back pressure valve (BPV) 100 is disclosed. The BPV 100 may include two modules, a manifold section 102, and an on-off section 104. In embodiments, the manifold section 102 has a poppet which is spring loaded. Details of the poppet 202 are illustrated in FIGS. 2A and 2B. With the aid of spring force provided by a spring 204, the poppet 202 seals against the hydrostatic pressure plus the additional pressure required to keep the carbon dioxide in the dense form. As illustrated in FIG. 2A, the BPV 100 is in a closed condition. In this condition, the poppet 202 is sealed on the downward end, preventing reservoir contents from escaping to the atmosphere. In FIG. 2B, the BPV 100 is in an open position. In this condition, the poppet 202 is sealed on the upward end. In this state, injection of fluids may occur and enter the side of the BPV 100 to pass through the BPV 100 to the reservoir. A movable piston 206, is provided and opened in this configuration to allow the high-pressure injection to occur, thus opening the piston 206. After the injection, the piston 206 may move back to a resting position, thus putting the BPV 100 in a state illustrated in FIG. 2A.

Referring back to FIG. 1, the on-off section 104 may be configured with a choke housing which is, in turn, connected to an indexer 106. In embodiments, the indexer 106 may be a J slot indexer, that can be adjusted to serve different flow areas. In embodiments, operation is performed through pressure pulses generated from the injection of carbon dioxide. Control lines from the surface are not needed with this configuration and provide a significant improvement over conventional apparatus. As will also be understood, aspects of the disclosure may operate without the need for an indexer, thus the description is but one non-limiting embodiment.

Aspects of the BPV valve 100 provide for an initial position of the valve 100 in a closed position. The valve 100 is in the closed position based upon the piston 206 which chokes flow. A piston area is exposed to hydrostatic pressure as well as a spring force that is provided by a spring 204. In the illustrated embodiment, the double ended poppet valve 202 is biased "upward" so that the underside of the sealing mechanism 210 is placed on a poppet seat 212.

The BPV 100 is configured to translate internal components that will allow the BPV 100 to assume a different configuration when pressure is increased from the surface (upward) direction. With an increase in the injection pressure, such as an injection of carbon dioxide from the surface down to the BPV 100, the poppet 202 shifts, closing the hydrostatic pressure reaching the piston 206. The poppet 202 then establishes the lower pressure from the reservoir side to the piston 206. The relatively high pressure from the hydrostatic side outside of the BPV valve 100 will push the piston 206 towards the low pressure side, compressing the spring 204 in the on-off section 104. This movement will shift the indexer to the intermediate position.

When the injection pressure is reduced, this state pushes the poppet 202 on the manifold to its initial condition, reestablishing the high-pressure connection to the piston 206 of the on-off section 104. This movement reestablishes the choke side connection of the high-pressure hydrostatic side. At this point the piston 206 will experience the same pressure on both sides. The spring 204 moves the indexer which moves the piston 206 to the next position (valve open position). Similar steps may be repeated, as described above, to close the BPV valve 100 or to shift the valve 100 to the next position. As will be understood from the FIGS., the poppet 202 has an interior faced poppet portion that is closed and an exterior poppet portion that is open when the BPV 100 is in the closed position. Moreover, the poppet 202 has an interior faced poppet portion that is open and an exterior poppet portion that is closed when the BPV 100 is in the open position.

Figure 3:
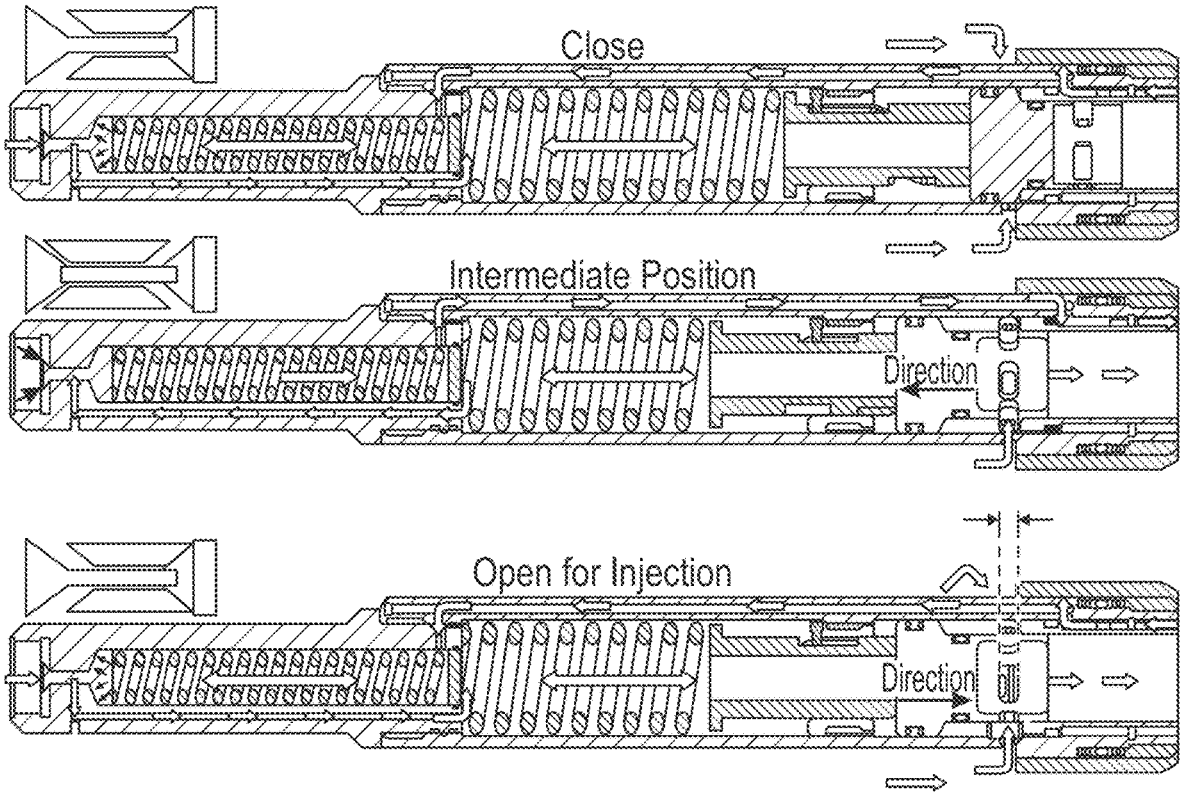
FIG. 3 is a side sectional view of the back pressure valve in a closed (top), intermediate (middle) and open (bottom) position in one example embodiment of the disclosure.

As illustrated in FIG. 3, the valve 100 is presented in the closed (top), intermediate (middle) and open (bottom) positions for comparison. As will be understood, transitioning between the states illustrated may be accomplished without need for operator intervention and control lines. This offers a significant improvement over conventional systems that require constant attention and monitoring by operators.

Aspects of the disclosure may be operated in conjunction with wireline activities. As the valve 100 does not require monitoring devices, as soon as the flowing pressure reduces from a predefined range, the valve 100 shuts and maintains the required pressure to keep carbon dioxide in a liquid state. This allows for a faster response valve and system wherein the valve closing is immediate.

Figure 4:
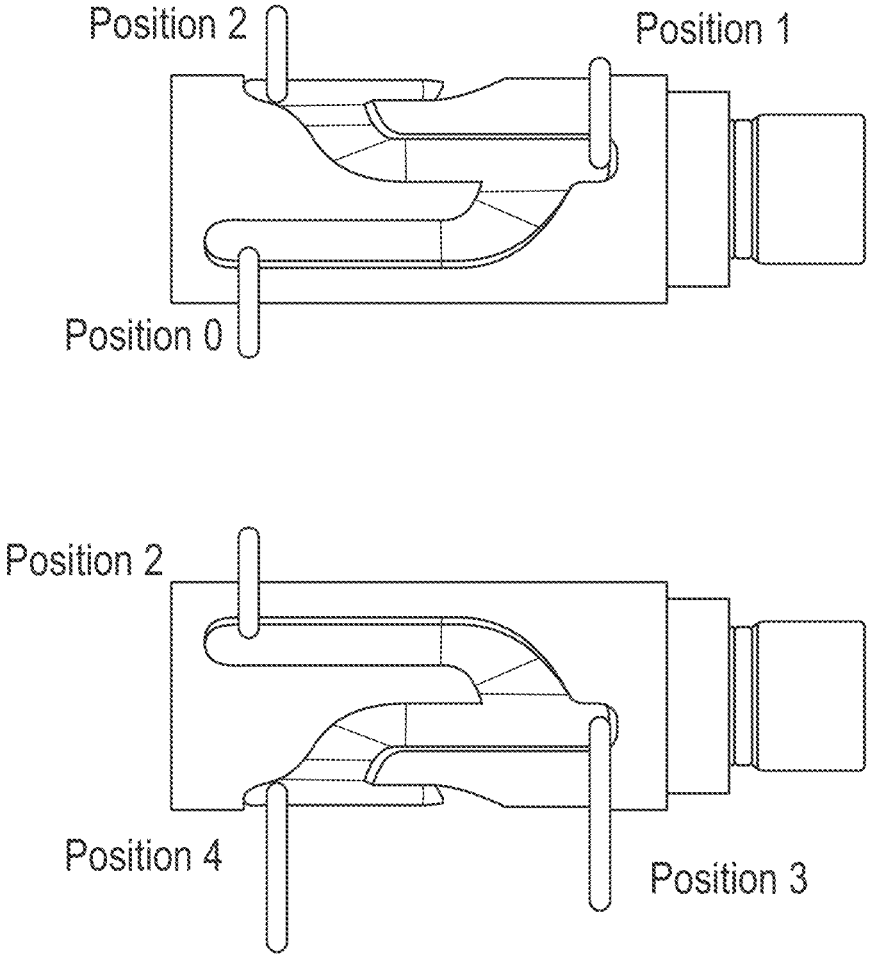
FIG. 4 is a side view of a back pressure valve opening at different pressure values in one example embodiment of the disclosure.

Referring to FIG. 4, different positions of the valve 100 are illustrated corresponding to different indexing positions. Example surface pressure valves, located in Tables 1 and 2 below, illustrate potential non-limiting values for indexing positions. Table 1 illustrates indexing positions 0, 1 and 2 corresponding from a closed to an open status. Table 2 illustrates indexing positions 2, 3 and 4 corresponding from an open status to a closed status. The values in Tables 1 and 2 are well independent and may vary accordingly.

TABLE 1

| Indexer Position | Surface Pressure | Valve Status |
|---|---|---|
| 0 | Min 750 psi | Closed |
| 1 | Max 2500 psi | Open Intermediate |
| 2 | Min 750 psi | Open |

*Maintain 750 to 1000 pounds per square inch when flowing

**Minimum poppet cracking pressure 1000 pounds per square inch

TABLE 2

| Indexer Position | Surface Pressure | Valve Status |
|---|---|---|
| 2 | Min 750 psi | Open (Injecting) |
| 3 | Max 2500 psi | Open Intermediate |
| 4 | Min 750 psi | Closed |

Figure 5A:
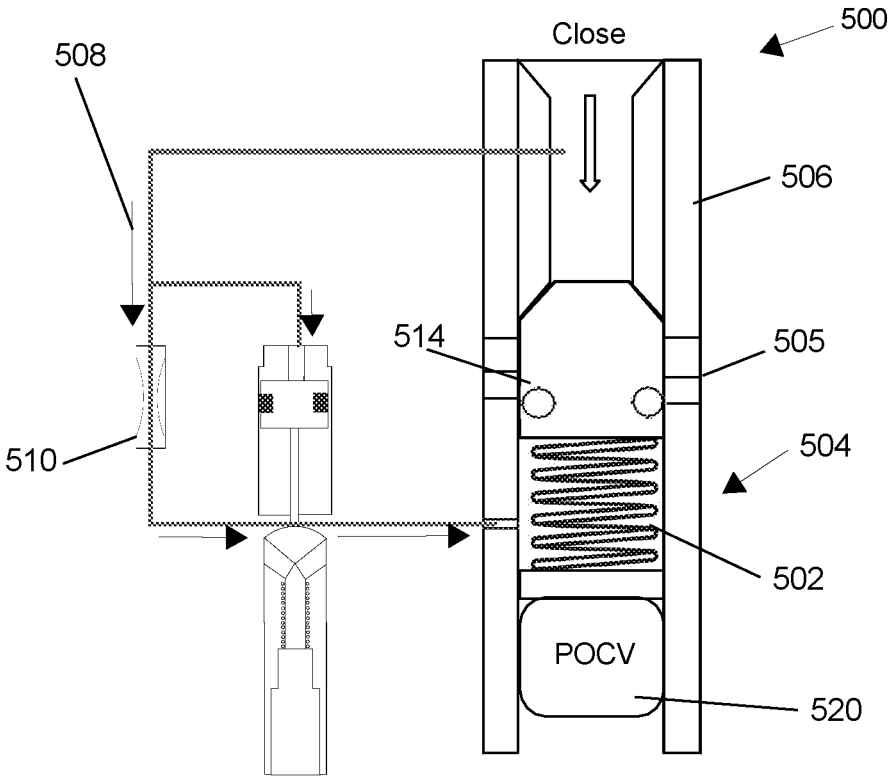
FIG. 5A is a side view of a closed back pressure valve and associated equipment in one example embodiment of the disclosure.
Figure 5B:
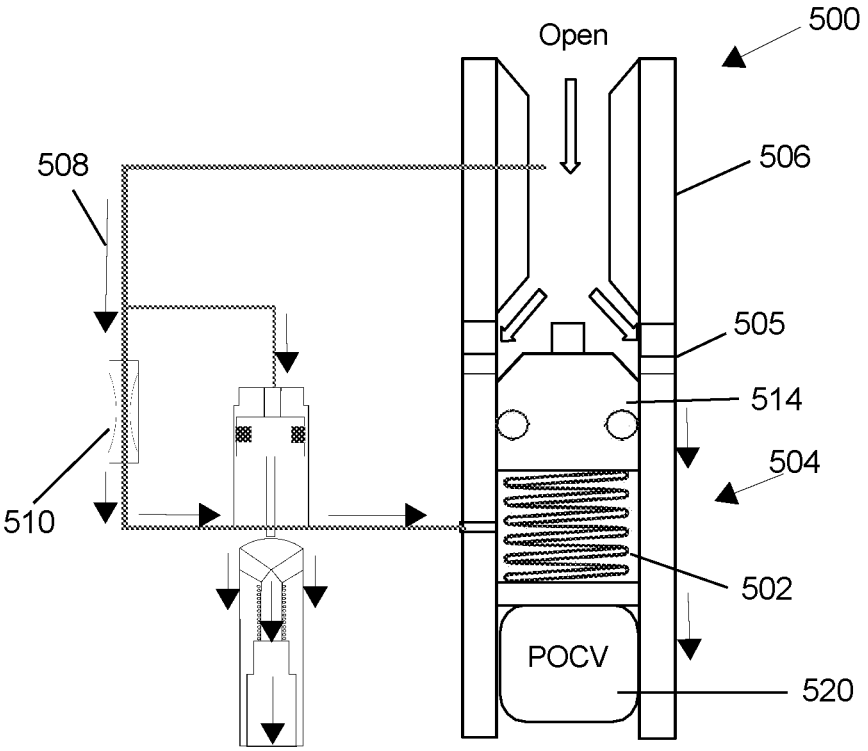
FIG. 5B is a side view of an open back pressure valve and associated equipment in one example embodiment of the disclosure.

Referring to FIGS. 5A and 5B, a back pressure valve (BPV) 500 which is actuated with the pressure pulses generated from tubing or a similar source. The BVP 500 may include two main modules, the on-off section and a manifold section 504. The actuation of a piston is achieved by the manifold section 504 which includes a pilot activated check valve (POCV) 520 and the flow restrictor. In an alternative embodiment, the position of the piston can be controlled using an indexer. In embodiments, a J slot indexer, similar to the embodiments illustrated in FIGS. 1 through 4 may be used.

In FIGS. 5A and 5B, the main components of this valve are shown in the closed (FIG. 5A) position and the open (FIG. 5B) position. Referring to FIG. 5A, a spring 502 is positioned such that ports 505 in a body 506 are not exposed as the ports 505 are covered by a movable piston 514. In this configuration, pressure 508, noted by the arrow at the top is carried down to a flow restrictor 510 and valve assembly 512. As the high pressure is exposed on to the top of the piston 514 and spring 502, the spring 502 bias keeps the piston 514 in an upward condition. In this configuration, no flow is incurred through the flow restrictor 510.

In FIG. 5B, an open position is illustrated. The POCV 520 allows flow down from the flow restrictor 510. The flow through the flow restrictor may progress outside the body 506, thereby causing a pressure drop over the flow restrictor 510. The check valve side of the POCV 520 allows fluid to enter the low-pressure side of the piston 514, thereby allowing the piston 514 to move and open the series of ports 505 in the body 506. Flow is then permitted through the ports 505, thereby allowing the relatively higher-pressure injection of carbon dioxide to progress downhole.

Figure 6:
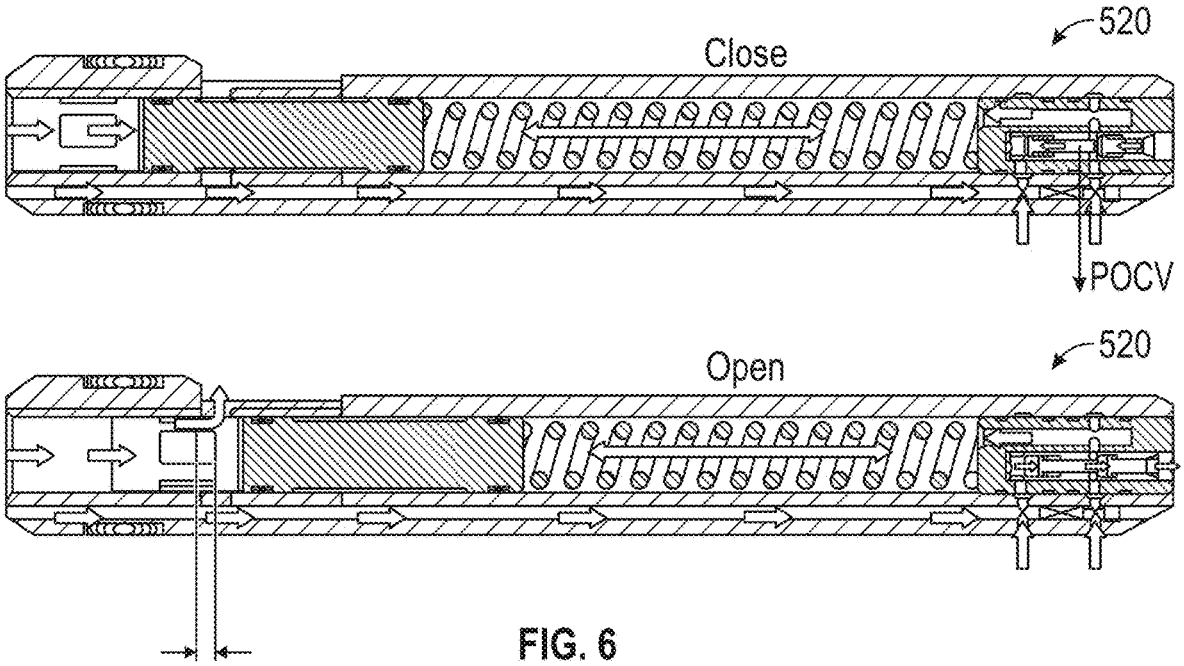
FIG. 6 is an alternative design of a back pressure valve in one example embodiment of the disclosure.

Initially, both sides of the piston 514 are pressure balanced and the spring keeps the piston in the closed condition, When the injection pressure is increased, the check valve side of the POCV 520 opens and starts bleeding into the low-pressure reservoir. The pilot side (right side) of the POCV 520 which is exposed to high pressure keeps the check valve side (left side) open. The pressure drop achieved from the flow through the flow restrictor 510 is exposed to the spring 502 side of the piston 514. This pressure differential on the piston 514 moves the piston 514 to the open position. To close, the injection pressure is reduced, which moves both the pilot operated side and the check valve side to its initial position equalizing the pressure on the on-off piston 514. The spring 502 then moves the piston 514 back to the original closed position. A cross-section of the POCV 520 is illustrated in a closed position in FIG. 6 (top) and an open position in FIG. 6 (bottom).

Figure 7:
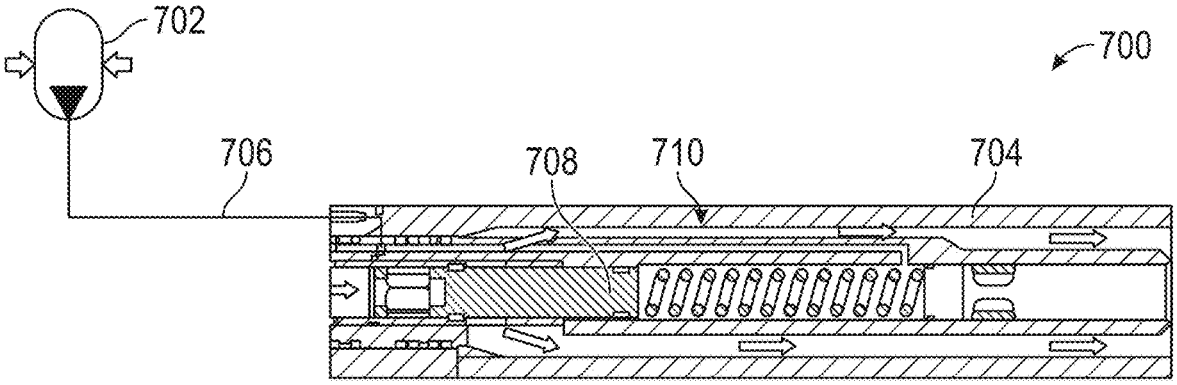
FIG. 7 is a design of a back pressure valve coupled to a pressure control apparatus in one example embodiment of the disclosure.

In another non-limiting embodiment, a back pressure valve (BPV) 700 including two modules, a spring-loaded valve 704 and a control line 706 which is surface controlled. Referring to FIG. 7, a high pressure on a tubing side opens a valve 700 compressing fluid in a chamber 702. When tubing pressure is reduced, the valve 700 shuts due to the pressure from a compressor. A landing sleeve or body may be provided housing the spring-loaded valve 704. In embodiments, the valve 704 may be biased towards a closed position wherein liquid carbon dioxide stored in a reservoir underneath the valve 704 may act as a closing pressure for the valve 704. Opening of the valve 704 may come through pressure actuation from a fluid within the control line 706 overcoming the pressure acting upon the spring-loaded valve 704. In embodiments, pressure from the control line 706 may open the spring-loaded valve 704 thus opening a pathway for fluid to translate down the inside surfaces of the valve to the reservoir.

Figure 8:
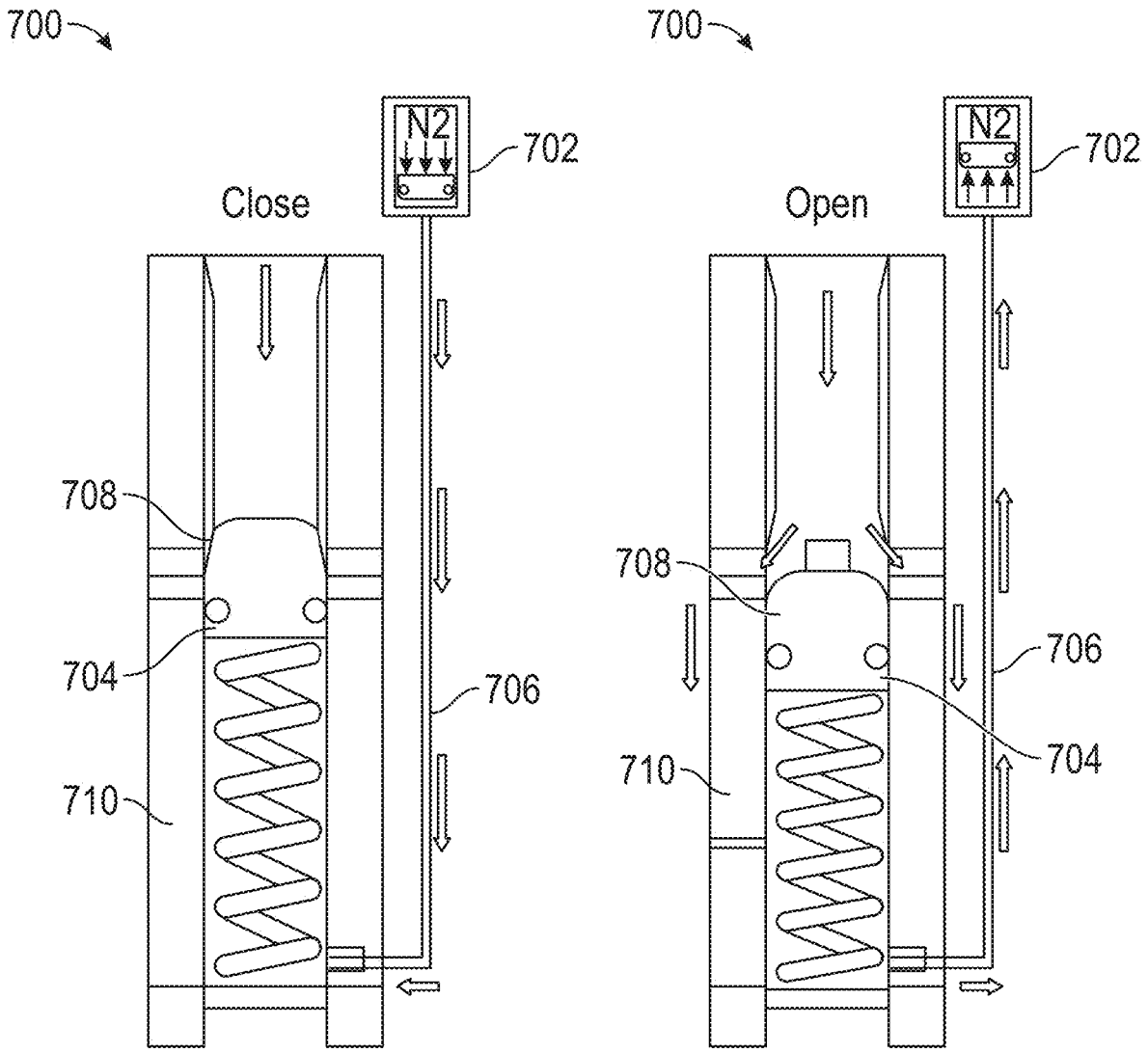
FIG. 8 is a design of a back pressure valve coupled to a nitrogen surface pressure chamber in one example embodiment of the disclosure.

The valve 700 has a piston 708 which is in the closed state due to the pressure from the control line 706 connected to the surface pressure chamber 702. The pressure values for actuation of the valve are preset. On one side, the piston 708 is exposed to the pressure from the tubing. When the tubing pressure is increased, the pressure compresses the charged piston 708 at the surface and the valve 700 is opened as the piston 708 moves. When the injection pressure is reduced, the compressed fluid will push the piston 708 back closing the valve 700. In one embodiment, the valve 700 is a retrievable type and can be sealed to a landing sleeve 710. By adjusting the accumulator pressure, tubing flow can be achieved to various reservoir pressures and flow rates. A cross-section of the valve 700 in the closed position is shown at the left side of FIG. 8. A cross-section of the valve 700 in the open position is shown at the right side of FIG. 8. As illustrated, the surface pressure chamber may use inert nitrogen for pressurization. The fluid is under pressure control from one of a constant volume within the surface pressure chamber or an operator input. When under control from an operator input, the pressure may be varied through use of a fluid pump. As will be understood, various fluids may be used in connection with the surface pressure chamber, including inert gases such as nitrogen.

Figure 9:
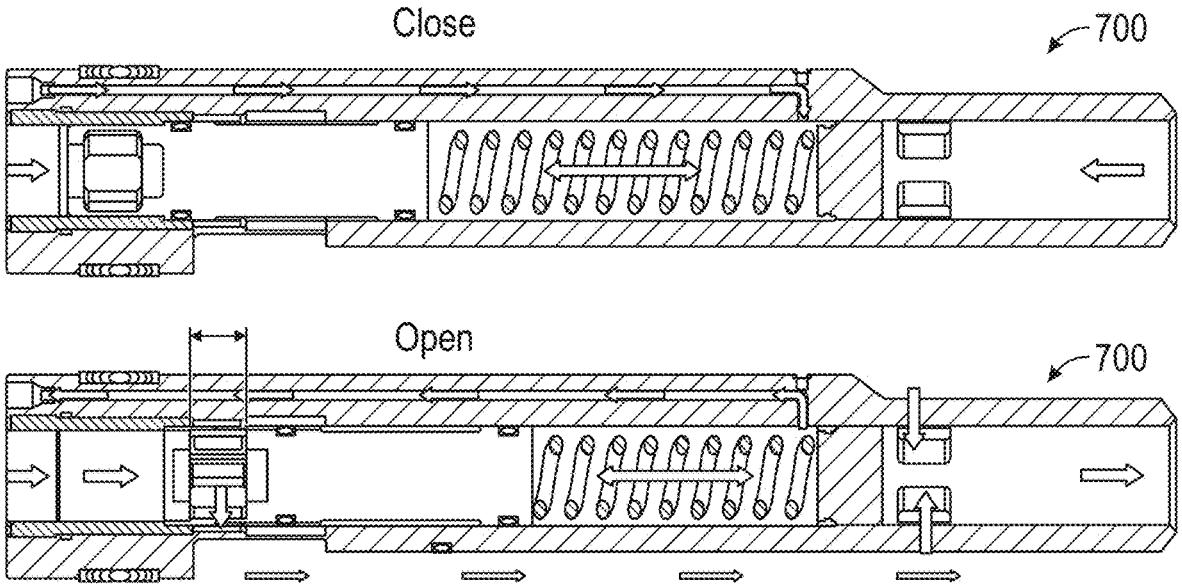
FIG. 9 is a sectional view of a back pressure valve in a closed configuration (top) and an open configuration (bottom) in one example embodiment of the disclosure.

Referring to FIG. 9, a closed valve configuration is presented in the top-most portion of the figure. An open valve configuration is presented in the bottom-most portion of the figure.

Figure 10:
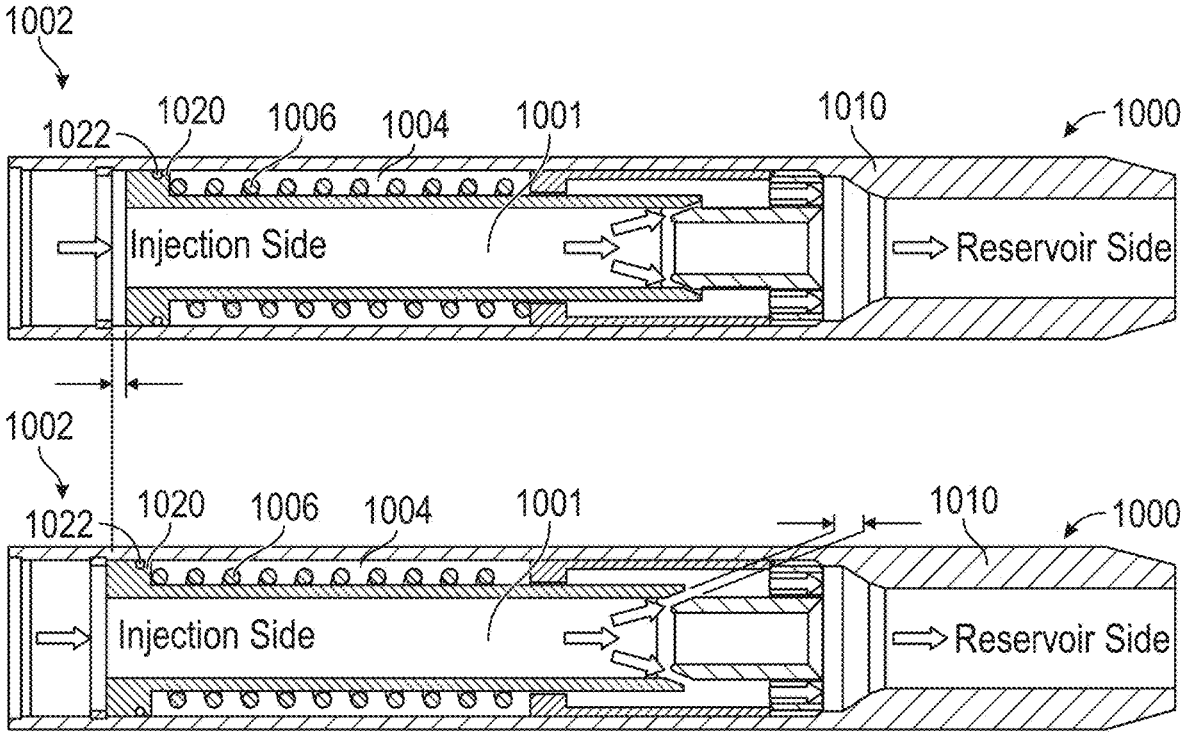
FIG. 10 is a sectional view of a back pressure valve reacting to various injection pressures exhibited on the valve from the surface in one example embodiment of the disclosure.

Referring to FIG. 10, a metering module 1000 is illustrated. In embodiments the metering module 1000 is connected to the back pressure valve (BPV) 1001 or similar valve. The metering module 1000 adjusts a flow area based on the injection and reservoir pressure.

The metering module 1000 has a metering section 1002 as well as a spring-loaded piston 1004. The stiffness of the spring 1006 for the spring-loaded piston 1004 is selected to maintain a certain flow area by opposing the injection flow rates. The metering module 1000 has a body 1010 that houses the metering section 1002 and the spring-loaded piston 1004. The spring 1006 is positioned to bias the piston 1004 to the closure side (left side) of FIG. 10. The right side of FIG. 10 represents the storage volume of liquid carbon dioxide retained by the metering module 1000. The left side of FIG. 10 represents the injection side. A stopper 1020 is positioned such that the spring-loaded piston 1004 will seat against the stopper 1020 when pressure opens the spring-loaded piston 1004. After injection and the increase in total pressure from liquid carbon dioxide, the spring-loaded piston 1004 unseats from the stopper 1020 and returns to a neutral position, sealing the reservoir side (right side). A seal 1022 is provided at the left side of the piston 1004 to prevent fluid flow between the body 1010 and the piston 1004.

During injection, as the reservoir pressure increases over the period, the pressure increases and pushes the piston 1004 towards the stopper, increasing the flow area. This increase in flow area towards the valve 1001 allows to maintain similar flow rates without increasing the injection or compressor capacity.

The top-most cross-section of FIG. 10 provides a configuration in a closed position. The bottom-most cross-section of FIG. 10 provides a configuration in an open position. The features provide for a passive valve and do not require active surface control. The aspects described in relation to FIG. 10 may be run on wireline. The aspects described can be attached to a back pressure valve or similar valve to control the flow rate. The aspects described provide for a fast response.

Aspects of the disclosure herein reduce the number of errors in conventional analysis related to geological carbon capture systems. The innovative methods and technologies introduced ensure a more accurate and reliable analysis, thereby enhancing the overall efficiency and effectiveness of geological carbon capture endeavors. By minimizing analytical errors, the proposed solutions significantly improve the precision of geological assessments and carbon capture outcomes.

Worker safety is enhanced by the reduction in errors and the possibility of mistakes in the field from inaccurate engineering analysis. With fewer errors in geological analysis, the likelihood of hazardous situations arising from incorrect data interpretation decreases, thereby providing a safer working environment for field operators and engineers. An additional benefit is the prevention of accidents and incidents that could result from flawed engineering assessments, further safeguarding the workforce.

Aspects of the disclosure are superior to existing conventional technologies wherein less time is taken to perform analysis of complex field configurations and situations. The advanced systems described above enable quicker and more efficient responses to geological events or changes without need for operator interaction. This reduction in time not only accelerates project timelines but also allows for more responsive decision-making in dynamic field conditions, ultimately leading to more effective and timely carbon capture operations.

Aspects of the disclosure solve the drawbacks of conventional analysis wherein efficient and economical ways to develop results are achieved that are not present with conventional technologies. The innovative approaches introduced provide a cost-effective solution to the challenges of geological carbon capture analysis. By leveraging advanced computational techniques and optimized workflows, the proposed methods deliver accurate results with reduced resource expenditure, making the entire process more sustainable and financially viable.

In each of the embodiments described above, the systems/valves/arrangement may be used in conjunction with a carbon capture system. In such systems, the carbon capture system may include a storage tank that is cryogenically cooled so that carbon dioxide contained therein may be stored. A pump may be used to remove liquid carbon dioxide from the storage tank, pressurize the liquid carbon dioxide, and inject the fluids into a wellbore equipped with the back pressure valves or arrangements described above. As will be understood, the wellbore may be insulated or designed to withstand thermal shock from temperature differentials that may occur. Designs of the systems/valves/arrangements may include the injection system that is present in the up-hole environment as part of the overall arrangement system. The injection systems and pumps used may be equipped and designed to withstand not only the liquid carbon dioxide, but also thermal gradients that may be present due to the environment that the injection system is located. Such environments may include arid environments such as dessert locations. Other possibilities exist where storage locations are provided in colder climates, thereby saving on energy costs for liquifying and/or cooling carbon dioxide. Although described above as pertaining to carbon capture systems, it will be understood that aspects of the disclosure may be used in enhanced gas recovery systems. In such systems, methane may be recovered from wellbores upon injection of liquid carbon dioxide. Such methane may be beneficially extracted and may be used for powering cooling units for the above-ground systems. Such activities may be performed, for example, in shale gas reservoirs. Aspects of the disclosure may be used in geological formations where cap-rock is more ductile and not prone to sudden fracture, thus limiting potential worker safety concerns.

Example embodiments of the claims are recited next. The embodiments disclosed should not be considered limiting of the disclosure. In one embodiment, a back pressure valve is disclosed. The back pressure valve may include a manifold section and an on-off section. The on-off section may be configured with a piston movable from a closed position to an open position and a double face poppet valve. The on-off section may also be configured with a spring connected to connected to the double face poppet valve, wherein the spring is configured to bias the double face poppet valve to a sealed position preventing a carbon dioxide liquid from escaping a reservoir.

In another example embodiment, the back pressure valve may be configured wherein the piston in the closed position prevents the carbon dioxide from passing through ports in a body of the valve.

In another example embodiment, the back pressure valve may be configured wherein the piston, in the open position, unseals the ports in the body of the valve allowing a flow of the carbon dioxide liquid.

In another example embodiment, the back pressure valve may be configured wherein the double ended poppet has an interior faced poppet portion that is sealed in a closed valve position while an exterior positioned portion is in an open position.

In another example, a back pressure valve is provided. This back pressure valve may include a body defining an interior volume. The back pressure valve may also include a series of ports extending through a side wall of the body. The back pressure valve may also include a piston placed within the body moveable from a closed position to an open position. The back pressure valve may also include a spring connected to the piston biasing the piston to the closed position covering the series of ports with a side of the piston. The back pressure valve may also include a pilot operated check valve placed within the interior volume having a pilot side and a check valve side. The back pressure valve may also include a flow restrictor connected to the body on the check valve side and configured to restrict a flow of liquid carbon dioxide traveling from a top of the piston to a bottom of the piston.

In another example, the back pressure valve may further include an indexer connected to the piston and the spring.

In another example, the back pressure valve may be configured wherein the indexer is a j-slot indexer.

In another example, the back pressure valve may be configured wherein a pilot side of the pilot operated check valve is placed within the interior volume.

In another example embodiment, a back pressure valve is disclosed. The back pressure valve may include a body defining an interior volume. The back pressure valve may also include a spring-loaded valve placed within the interior volume. The back pressure valve may also include a pressure vessel defining a pressure vessel interior volume. The back pressure valve may also include a control line having a first end and a second end, wherein the first end is connected to the pressure vessel and the second end is connected to the interior volume of the body.

In another example embodiment, the back pressure valve may be configured wherein the pressure vessel contains a fluid.

In another example embodiment, the back pressure valve may be configured wherein the fluid is nitrogen.

In another example embodiment, the back pressure valve may be configured wherein the fluid is under pressure control from one of a constant volume and an operator input for pressurization.

In another example embodiment, an apparatus is disclosed. The apparatus may include a metering module. The metering module may include a metering section and a spring-loaded piston. The apparatus may also include a valve, wherein the spring-loaded piston is biased towards a first closed position, and wherein the spring-loaded piston translates down a body of the metering module upon an increase in pressure from an injection end of the metering module, overcoming a bias pressure during the first closed position to a second open position allowing fluid to translate down the body of the metering module to a reservoir end section.

In another example embodiment, the apparatus may further include a stopper portion for the body, wherein the stopper portion bears on the spring-loaded piston in the second open position, limiting further travel of the piston.

In another example embodiment, the apparatus may further include a seal configured between the piston and the body, preventing transfer of liquid carbon dioxide down an axis of the apparatus.

In another example embodiment, the apparatus may be configured wherein the valve is a back pressure valve.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A back pressure valve arrangement, comprising:
- a manifold section; and
- an on-off section, wherein the on-off section is configured with a piston movable from a closed position to an open position;
- a double face poppet valve; and
- a spring connected to the double face poppet valve, wherein the spring is configured to bias the double face poppet valve to a sealed position preventing a carbon dioxide liquid from escaping a reservoir.

2. The back pressure valve arrangement according to claim 1, wherein the piston in the closed position prevents the carbon dioxide from passing through ports in a body of the valve.

3. The back pressure valve arrangement according to claim 2, wherein the piston, in the open position, unseals the ports in the body of the valve allowing a flow of the carbon dioxide liquid.

4. The back pressure valve arrangement according to claim 1, wherein the double face poppet valve has an interior faced poppet portion that is sealed in a closed valve position while an exterior positioned portion is in an open position.

5. The back pressure valve arrangement according to claim 1, further comprising:
- an injection system configured to receive liquid carbon dioxide from a source and inject the liquid carbon dioxide to a subsurface environment that houses the back pressure valve arrangement.

6. A back pressure valve arrangement, comprising:
- a body defining an interior volume;
- a series of ports extending through a side wall of the body;
- a piston placed within the body moveable from a closed position to an open position;
- a spring connected to the piston biasing the piston to the closed position covering the series of ports with a side of the piston;
- a pilot operated check valve placed within the interior volume having a pilot side and a check valve side; and
- a flow restrictor connected to the body on the check valve side and configured to restrict a flow of liquid carbon dioxide traveling from a top of the piston to a bottom of the piston.

7. The back pressure valve arrangement according to claim 6, further comprising: an indexer connected to the piston and the spring.

8. The back pressure valve arrangement according to claim 7, wherein the indexer is a J-slot indexer.

9. The back pressure valve arrangement according to claim 6, wherein the pilot side of the pilot operated check valve is placed within the interior volume.

10. The back pressure valve arrangement according to claim 6, further comprising:
- an injection system configured to receive liquid carbon dioxide from a source and inject the liquid carbon dioxide to a subsurface environment that houses the back pressure valve arrangement.

11. A back pressure valve arrangement, comprising:
- a body;
- a spring-loaded valve placed within the body and defining an interior volume with the body;
- a spring disposed within the interior volume and configured to bias the spring-loaded valve toward a closed position;
- a pressure vessel defining a pressure vessel interior volume; and
- a control line having a first end and a second end, wherein the first end is connected to the pressure vessel interior volume and the second end is connected to the interior volume with the spring.

12. The back pressure valve arrangement according to claim 11, wherein the pressure vessel contains a fluid.

13. The back pressure valve arrangement according to claim 12, wherein the fluid is nitrogen.

14. The back pressure valve arrangement according to claim 12, wherein the fluid is under pressure control from one of a constant volume and an operator input for pressurization.

15. The back pressure valve arrangement according to claim 11, further comprising:
- an injection system configured to receive liquid carbon dioxide from a source and inject the liquid carbon dioxide to a subsurface environment that houses the back pressure valve arrangement.

* * * * *